United States Patent [19]

Raisin

[11] 4,004,438

[45] Jan. 25, 1977

[54] THREAD FEED DEVICE FOR A HOSIERY KNITTING MACHINE

[75] Inventor: Jean-Pierre Raisin, Troyes, France

[73] Assignee: Institut Textile de France, Bouligne, France

[22] Filed: July 11, 1975

[21] Appl. No.: 595,145

[30] Foreign Application Priority Data

July 17, 1974 France ..... 74.24906

[52] U.S. Cl. ..... 66/132 R; 242/47.01; 226/178

[51] Int. Cl.² ..... D04B 15/48

[58] Field of Search ..... 66/132 R, 132 T; 242/47.01, 45; 226/178

[56] References Cited

UNITED STATES PATENTS

| | | | |
|---|---|---|---|
| 2,978,195 | 4/1961 | Weber et al. | 242/45 |
| 3,054,569 | 9/1962 | Weber et al. | 242/45 |
| 3,090,571 | 5/1963 | Lohest et al. | 242/45 |
| 3,455,341 | 7/1969 | Pfarrwaller et al. | 66/132 R |
| 3,523,433 | 8/1970 | Hatay | 242/45 X |
| 3,528,622 | 9/1970 | Schmidt | 242/47.01 |
| 3,675,446 | 7/1972 | Cooke | 66/132 T |

FOREIGN PATENTS OR APPLICATIONS

| | | | |
|---|---|---|---|
| 1,288,229 | 1/1969 | Germany | 66/132 |

*Primary Examiner*—Mervin Stein
*Assistant Examiner*—Andrew M. Falik

[57] ABSTRACT

A thread feed device for a hosiery knitting machine comprises a tensioning mechanism for the thread, a cylindrical drum for positively driving the thread, a shaft coaxial with the drum and having an axial groove therein cooperating with radially inwardly extending projection means on the drum, and a plurality of rotary magnetic drive members surrounding the shaft and cooperating with a magnetic core on the shaft so that, by movement of the shaft, the magnetic core can be selectively aligned with one of the rotary magnetic drive members.

12 Claims, 2 Drawing Figures

THREAD FEED DEVICE FOR A HOSIERY KNITTING MACHINE

BACKGROUND OF THE INVENTION

The invention relates to a thread feed device for a hosiery knitting machine and more particularly for a hosiery knitting machine of the circular type.

There already exist numerous types of thread feed devices for circular hosiery knitting machines. The principal condition which these thread feed devices must satisfy is to supply a thread which has simultaneously a perfectly determined rate of feed and tension. To this end, various thread feed devices have already been proposed in which this condition is realized due to the fact that the thread, which arrives at the said device in a first state of tension, passes, after its entrance into the said device, into a second state, which state is known as intermediate tension, in which its tension is effectively greater than that which it had previously and where it is consequently drawn out, then finally, after having passed around a rotatably driven drum which controls the rate of feed of the thread, the thread is released so that its tension returns to a value less than that corresponding to the said intermediate tension.

But such thread feed devices which comprise at least one cylindrical positive drive drum for the thread, a series of toothed or axially grooved pulleys coaxial to the drive drum and on each of which turns a toothed or grooved drive belt driven by the motor of the knitting machine, a coupling element integral in rotation with the drive drum, but movable axially with respect to the latter to permit the choice of which toothed pulley will be coupled to the drive drum, have the disadvantage of being, on the one hand, difficult to operate and handle due to the fact that the coupling element between the drive drum and the toothed pulleys is purely mechanical, and, on the other hand, of being rather cumbersome due to the fact that the thread tension mechanism which they must also comprise is generally constituted by a second cylindrical drum.

SUMMARY OF THE INVENTION

It is an object of the present invention, to propose a novel thread feed device for a hosiery knitting machine which has, on the one hand, the same advantages which the known above-mentioned feed devices have, while having, on the one hand, a space requirement which is clearly reduced and of a realization much more simple than the known feed devices.

According to the invention, there is provided a thread feed device for a hosiery knitting machine comprising a tensioning mechanism for said thread, a cylindrical drum for positive drive of the thread, a shaft coaxial with said drum, an axial groove in said shaft, a projection means on said drum extending radially inwardly of said drum for engagement in said axial groove, a plurality of rotary magnetic drive members surrounding said shaft and a magnetic core on said shaft and fixed for movement therewith and means permitting axial movement of said shaft relative to said drum and said rotary magnetic drive members to selectively align said magnetic core with one of said rotary magnetic drive members.

BRIEF DESCRIPTION OF THE DRAWINGS

The invention will now be described in greater detail, by way of example, with reference to the drawings, in which.

DESCRIPTION OF THE PREFERRED EMBODIMENTS

In one embodiment of the invention, in a device of the type described above, it is basically proposed that the coupling element between the cylindrical drive drum and the toothed or grooved pulleys is constituted by a shaft or central rod placed along the geometrical axis common to the drive drum and to the toothed pulleys, that this central rod is provided with a groove parallel to its axis and in which a finger, integral with the drive slides drum during the axial movements of the central rod, and that the central rod has a magnetic core intended to cooperate with one or the other of the pulleys containing magnetic material.

Thus a first advantage of the present invention appears, which advantage resides in the fact that the coupling element here being magnetic, it is no longer necessary to provide conventional mechanical coupling elements such as direct-drive dog-clutch systems which equipped the known feed devices. It thus becomes possible to reduce the axial length of the device, in particular thanks to the permitted reduction of the height of the series of toothed coaxial pulleys. Furthermore, the risks which are always possible of spots on the thread which passes in the proximity, are avoided.

Figure 1:
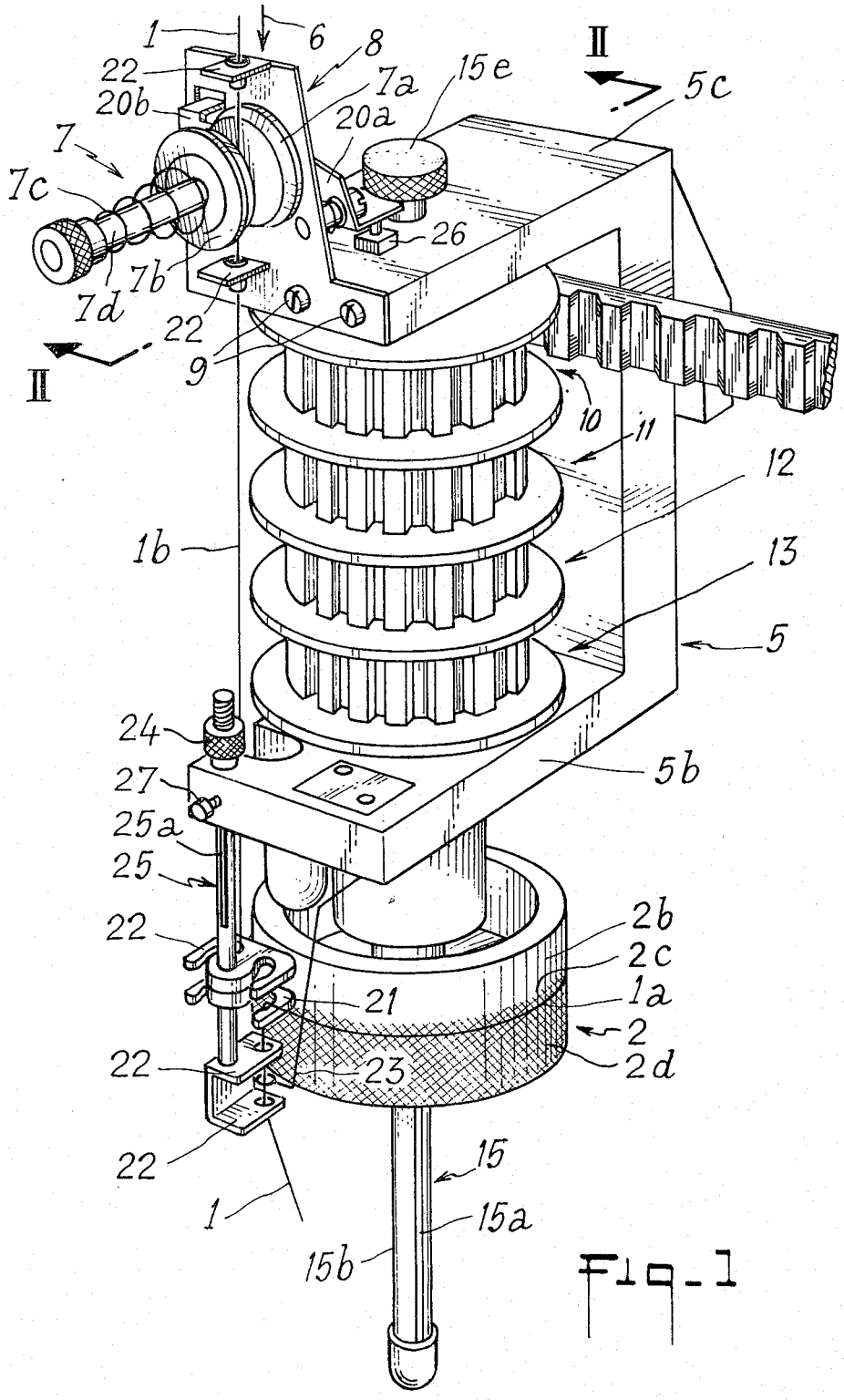
FIG. 1 shows a schematic elevational and perspective view of a thread feed device for a hosiery knitting machine in accordance with the invention, and, FIG. 2 shows a schematic axial section taken on the line II—II of the feed device of FIG. 1.
Figure 2:
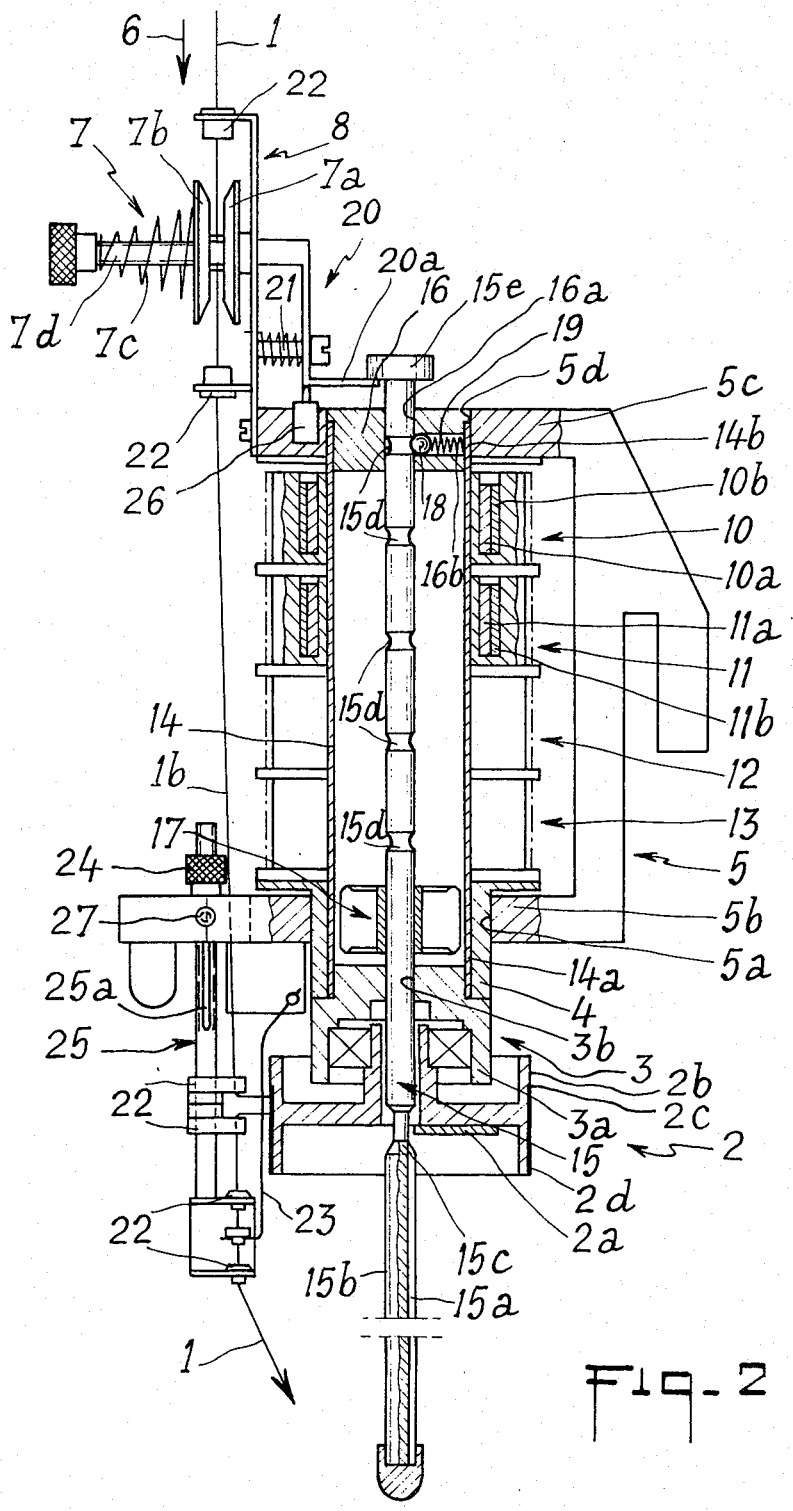

Referring now to the drawings, as can be seen in FIGS. 1 and 2, a thread feed device in accordance with the invention comprises a cylindrical drum 2 for the positive drive of the thread 1. This cylindrical drum 2 is mounted so as to rotate about its axis of rotation by means of a rolling mechanism 3. The frame 3*a* of this rolling mechanism 3 is fixed to a sleeve 4 which is, itself, mounted on the inside of a hole 5*a* cut in a plate 5*b* which constitutes the lower branch of a support 5 which has the shape of a U turned through 90°.

When the thread 1 arrives at the feed device in the direction of the arrow 6, it first passes through a tension mechanism 7 constituted by cup stretchers 7*a* and 7*b*. These two cups 7*a* and 7*b*, between which the thread 1 passes, are pressed one against the other by a spring 7*c* wound round a rod 7*d* which passes through the cups 7*b* and 7*a* and which is fixed to a vertical plate 8. This vertical plate 8 is, itself, screwed by screws 9 to the plate 5*c* which constitutes the upper branch of the U-shaped support 5.

The feed device in accordance with the invention also comprises a series of toothed pulleys 10, 11, 12 and 13 coaxial to the drive drum 2 and mounted idly rotating about a tube 14 of non-magnetic material. Toothed motor belts, pass around each one of the toothed pulleys 10, 11, 12 and 13 and are driven by the motor of the knitting machine with which is associated a speed changer. The tube 14 of non-magnetic material is fixed at its lower extremity 14*a* in the sleeve 4 and, at its upper extremity 14*b* in a hole 5*d* provided in the upper plate 5*c* of the U-shaped support 5.

A central rod 15 is placed along the geometrical axis which is common to the drive drum 1 and to the toothed pulleys 10, 11, 12 and 13, and is axially movable. This central rod 15 slides on the one hand, in a hole 3*b* provided at the centre of the frame 3*a* on the rolling mechanism 3, and, on the other hand, in a hole 16*a* provided at the centre of a closure member 16 which closes the hole 5*d* of the upper plate 5*c* of the U-shaped support 5. A groove 15*a* parallel to the axis of the central rod 15 is provided along a generatrix of the lower part 15*b* of the central rod 15.

A finger 2*a*, integral with the drive drum 2, is intended to cooperate with the groove 15*a* of the central rod 15 and to rotationally immobilise the drive drum 2 with respect to the central rod 15, the finger 2*a* sliding in the groove 15*a* during axial displacements of the central rod 15.

The central rod 15 also carries on its median part a magnetic core 17, which is rigidly fixed with the latter of which is intended to cooperate with one or other, according to the position of the central rod 15, of magnetic materials 10*a*, 11*a*, . . . which are contained respectively in each of the toothed pulleys 10, 11, 12 and 13. It will be easily seen that it is thus possible to couple the drive drum 12 with each one of the toothed pulleys 10, 11, 12 and 13, and consequently, to choose the speed at which the drive drum 2 will rotate.

A fifth position, shown by FIG. 2, is provided for the central rod 15, in which position the magnetic core 17, fixed with the central rod 15, is not coupled to any one of the toothed pulleys 10, 11, 12 and 13 which are thus all idle with respect to the central rod 15, and where the finger 2*a*, itself, is situated above the end 15*c* of the groove 15*a* of the central rod 15, in such a manner that the drive drum 2 is also idle with respect to the central rod 15 when this latter is found in this fifth position.

The maintenance of the central rod 15 in each one of the five above-mentioned positions is ensured by a small ball 18 placed in a radial hole 16*b* cut in the closure member 16 and which is urged towards the central rod 15 by a spring 19, the rod 15 having a series of five annular recesses 15*d* each corresponding to one of the said positions.

The magnetic parts 10*a*, 11*a* . . . contained in each one of the said toothed pulleys 10, 11, 12 and 13 are each constituted by a rim or a cylindrical crown of magnetic rubber and are surrounded by a ring 10*b*, 11*b* . . . of mild steel to improve the magnetic coupling between the rim or cylindrical crown 10*a*, 11*a* . . . and the magnetic core 17 fixed with the central rod 15.

The central rod 15 has, at its upper extremity, a shoulder 15*e* which comes to rest on one arm 20*a* of a two armed lever 20 when the central rod 15 is located in the above-mentioned fifth position. In this case the other arm 20*b* of this two armed lever 20, which rotates about an axis 21 fixed to the plate 8 and parallel to the rod 7*d* of the cup stretcher 7, engages between the two cups 7*a* and 7*b* of the cup stretcher 7, to separate the cups 7*a* and 7*b*, thus freeing the thread 1 from between the cups 7*a* and 7*b*.

The feed device also comprises a certain number of elements of known types and which will not be described in detail, such as thread guides 22 or a broken-thread detector 23 which are disposed in a conventional manner at the usual places.

The operation of the device being substantially the same as that of the already known feed devices, will only be described briefly.

In the course of operation, the drive drum 2 turning at the chosen speed as a function of the position of the central rod 15 pulls on the thread 1, of which one part 1*a* makes a turn of its lateral surface and thus induces a supplementary tension, known as the intermediate tension, in the part 1*b* of the thread included between the said part 1*a* and the tension mechanism, the cups 7*a* and 7*b* of which tighten, and consequently, retain the thread 1.

It can thus be assured, as a result of the tensioning mechanism 7, that the tension of the thread in its part 1*b* does indeed have a predetermined value, and, due to the drive drum 2, that the length of the thread fed under this tension indeed also has a predetermined value.

Various modifications may be made to the above described device. For example it is possible to provide on the lateral surface of the drive drum 2 two different zones 2*d* and 2*b* separated by a boundary in the form of a circle 2*c*. The first of these zones, 2*d*, is constituted by a surface having a high coefficient of friction and is that intended for the normal positive drive of the thread 1 whose part 1*a* is driven without sliding by the first zone 2*d*. The second zone, 2*b*, is, itself, constituted by a polished surface on which the part 1*a* of the thread 1 can slide.

A threaded knob 24 permits the axial displacement, of a threaded support rod 25 supporting the thread guide 22, the support rod 25 having a groove 25*a* in which slides the point of a screw 27 fixed with the lower plate 5*b* of the U-shaped support 5 and thus allows control of the part 1*a* of the thread 1 either onto the zone 2*d* or onto the zone 2*b* of the drive drum 2.

Finally, the device may comprise a security device comprising a contact 26 connected in series with the coupling circuit of the knitting machine, so that a setting into motion of the knitting machine before having re-coupled the drive drum 2 at a normal operating position is avoided. The security device may be provided with an illuminated or other visual indication.

It will be understood that the above description of the present invention is susceptible to various modification changes and adaptations.

What is claimed is:

1. A thread feed device for a hosiery knitting machine comprising a tensioning mechanism for said thread a cylindrical drum for positive drive of the thread, a shaft coaxial with said drum, an axial groove in said shaft, a projection means on said drum extending radially inwardly of said drum for engagement in said axial groove, a plurality of rotary magnetic drive members surrounding said shaft and a magnetic core on said shaft and fixed for movement therewith and means permitting axial movement of said shaft relative to said drum and said rotary magnetic drive members to selectively align said magnetic core with one of said rotary magnetic drive members.

2. A device as defined in claim 1, wherein said rotary magnetic drive members each comprise a toothed or axially grooved pulley having magnetic material therein.

3. A device as defined in claim 2, wherein said projection means comprises a radially inwardly directed finger.

4. A device as defined in claim 3, and comprising a plurality of toothed or grooved drive belts each cooperating with a said toothed or axially grooved pulley for driving said pulley.

5. A device as defined in claim 4 wherein said pulleys each comprise a rim or cylindrical crown of magnetic rubber and a ring of mild steel surrounding said rim or cylindrical crown for improving a magnetic coupling between said rim cylindrical crown and said magnetic core fixed to said shaft.

6. A device as defined in claim 4, and comprising means for the axial immobilization of said shaft in a plurality of positions corresponding to the coupling of said magnetic core fixed with said shaft with said magnetic material of said pulleys, and in a further position in which said core is maintained away from said magnetic materials of said pulleys.

7. A device as defined in claim 6 wherein said means for the axial immobilization of said shaft comprises a series of annular recesses defined by said shaft cooperating with a spring urged ball in a rotary bearing for said shaft.

8. A device as defined in claim 6, wherein said groove defined by said shaft comprises a slot of a length which enables engagement of said finger of said drum in said slot in said plurality of positions of said shaft and disengagement of said finger of said drum from said slot in said further position of said shaft.

9. A device as defined in claim 6 wherein said tensioning mechanism for said thread comprises a cup stretcher including a pair of cups and means permitting the separation of said cups when said shaft is located in its said further position.

10. A device as defined in claim 9 wherein said means permitting the separation of said cups of said tensioning mechanism comprises a two armed member pivoted about a fixed pivot and including a first arm on an extremity of which a shoulder provided on said shaft rests when said shaft is located in its said further position and a second arm engaging between said cups of said tensioning mechanism, when said shaft is located in its said further position.

11. A device as defined in claim 4 wherein said drive drum comprises on its peripheral cylindrical surface two regions having different coefficients of friction with respect to the thread, and wherein the feed device further comprises means permitting the choice of with which of said two regions the thread will be in contact.

12. A device as defined in claim 11 wherein said means permitting the choice of said two regions of said drive drum comprises a threaded knob and a threaded rod serving as the support for the thread guides and around which said threaded knob is screwed.

* * * * *